US006911134B2

(12) United States Patent
Dees et al.

(10) Patent No.: US 6,911,134 B2
(45) Date of Patent: Jun. 28, 2005

(54) THREE-ELECTRODE METAL OXIDE REDUCTION CELL

(75) Inventors: Dennis W. Dees, Downers Grove, IL (US); John P. Ackerman, Downers Grove, IL (US)

(73) Assignee: The University of Chicago, Chicago, IL (US)

( * ) Notice: Subject to any disclaimer, the term of this patent is extended or adjusted under 35 U.S.C. 154(b) by 482 days.

(21) Appl. No.: 10/236,133

(22) Filed: Sep. 6, 2002

(65) Prior Publication Data

US 2004/0045835 A1 Mar. 11, 2004

(51) Int. Cl.[7] ..... C25C 5/04; C25C 3/34

(52) U.S. Cl. ..... 205/43; 205/47; 205/354; 205/363; 205/367; 205/368

(58) Field of Search ..... 205/43, 47, 354, 205/363, 367, 368

(56) References Cited

U.S. PATENT DOCUMENTS 2,480,474 A * 8/1949 Johnson ..... 205/379
2,774,729 A * 12/1956 Meister ..... 205/47
3,272,726 A * 9/1966 Allan et al. ..... 205/47
4,588,485 A * 5/1986 Cohen et al. ..... 205/398
4,995,948 A * 2/1991 Poa et al. ..... 205/47
6,540,902 B1 * 4/2003 Redey et al. ..... 205/354
2004/0007466 A1 * 1/2004 Seo et al. ..... 205/43

* cited by examiner

*Primary Examiner*—Roy King
*Assistant Examiner*—Harry D Wilkins, III
(74) *Attorney, Agent, or Firm*—Emrich & Dithmar LLC; Harry M. Levy

(57) ABSTRACT

A method of electrochemically reducing a metal oxide to the metal in an electrochemical cell is disclosed along with the cell. Each of the anode and cathode operate at their respective maximum reaction rates. An electrolyte and an anode at which oxygen can be evolved, and a cathode including a metal oxide to be reduced are included as is a third electrode with independent power supplies connecting the anode and the third electrode and the cathode and the third electrode.

40 Claims, 5 Drawing Sheets

Three–Electrode Metal Oxide Reduction Cell

Three–Electrode Metal Oxide Reduction Cell

THREE-ELECTRODE METAL OXIDE REDUCTION CELL

CONTRACTUAL ORIGIN OF THE INVENTION

The United States Government has rights in this invention pursuant to Contract No. W-31-109-ENG-38 between the U.S. Department of Energy (DOE) and The University of Chicago representing Argonne National Laboratory.

BACKGROUND OF THE INVENTION

This invention relates to an electrochemical cell used in reducing a metal oxide or a combination of metal oxides to the corresponding metal in which an electric potential is established between an anode and cathode, usually in a molten salt electrolyte. In general, the molten salt electrolyte is selected from one or a combination of the alkali metal halides or the alkaline metal earth halides and the oxide to be reduced is positioned in a container which acts when filled with the metal oxide as a cathode, and the anode is generally some material which is impervious to attack by the products in an anode reaction or by the electrolyte or dissolved materials within the electrolyte.

In general, the reaction is according to the following wherein the base metal is (M) and the oxide to be reduced is ($MO_x$), both contained in a molten salt electrolyte, the electrochemical cell operating according to the overall reaction (1):

$$MO_x \rightarrow M + \frac{x}{2}O_2 \quad [1]$$

Although this invention will be explained using an example of spent oxide-based nuclear fuels, which are mostly uranium oxide, the invention is not so limited and pertains to variety of metals such as the actinide and rare earths, except for those metal oxides having sufficiently negative Gibbs free energy of formation such that reduction is not commercially advantageous. Classically this process is accomplished with a two-electrode electrochemical cell having a cathode where the metal oxide is reduced to the metal and a second electrode where oxygen is evolved through the oxidation of oxygen anions, called the anode. The individual electrode reactions are given by [2] for the cathode and [3] for the anode.

$$MO_x + 2xe^- \rightarrow M + xO^{-2} \quad [2]$$

$$2O^{-2} \rightarrow O_2 + 4e^- \quad [3]$$

Although a number of molten salts, such as $CaCl_2$ can be used for the electrolyte in this process, work has concentrated on lithium chloride. An oxide traditionally has to be present in the electrolyte melt to sustain a significant current density at the oxygen-evolving anode.

Several difficulties with the two-electrode cell have been identified. These include: (1) Cell control for optimum efficiency. It is necessary to maintain the anode potential at the highest possible value to increase cell throughput, but this value must be kept below the potential where excessive chlorine evolution occurs. Likewise, the cathode must be maintained at the lowest practical potential for best throughput, but not so low that metallic lithium is deposited on and in the metal oxide. Maintaining these voltages requires a very stable reference and a good means for constantly adjusting the power supply output. The voltage must be limited to accommodate whichever electrode is slowest at various stages of the reduction process; the current, and hence the rate, is limited correspondingly. (2) Elimination of oxygen-containing compounds from the cell. Any oxygen compounds in the cathode product or the electrolyte that is inevitably carried with the cathode product are deleterious to following operations. These compounds include lithium oxide in the electrolyte and unreduced oxides, such as rare earth oxides, that will be mixed with the cathode product and can not be eliminated without generating excessive chlorine. (3) The demanding performance requirements that this cell places on the anode. The current in a two-electrode cell is highest at the beginning of operation, and decays to a low value at the end. The anode must support the full current of the cell early in the reduction process, and must continue to function without excessive chlorine generation at the end of the process, when it is desirable to reduce the lithium oxide concentration in the electrolyte, preferably to one ppm or less.

SUMMARY OF THE INVENTION

Accordingly, it is an object of the present invention to provide an electrochemical cell in which neither the cathode nor the anode rate limits the other during the electrochemical reduction of metal oxides to the corresponding metal and a method of operating same.

Yet another object of the present invention is to use an electrochemical cell and method of reducing metal oxides to the actinides and most of the rare earth metal.

Still another object of the present invention is to provide an electrochemical cell and method of reducing metal oxides in which the voltage potentials of the cathode and the anode are independently established and controlled in order to completely reduce the metal oxide.

Yet another object of the invention is to provide an electrochemical cell and method of reducing metal oxides in which the neither the anode nor the cathode is limited and the oxide ion concentration in the electrolyte, at the end of the cell operation is low.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PRESENT INVENTION

Figure 1:
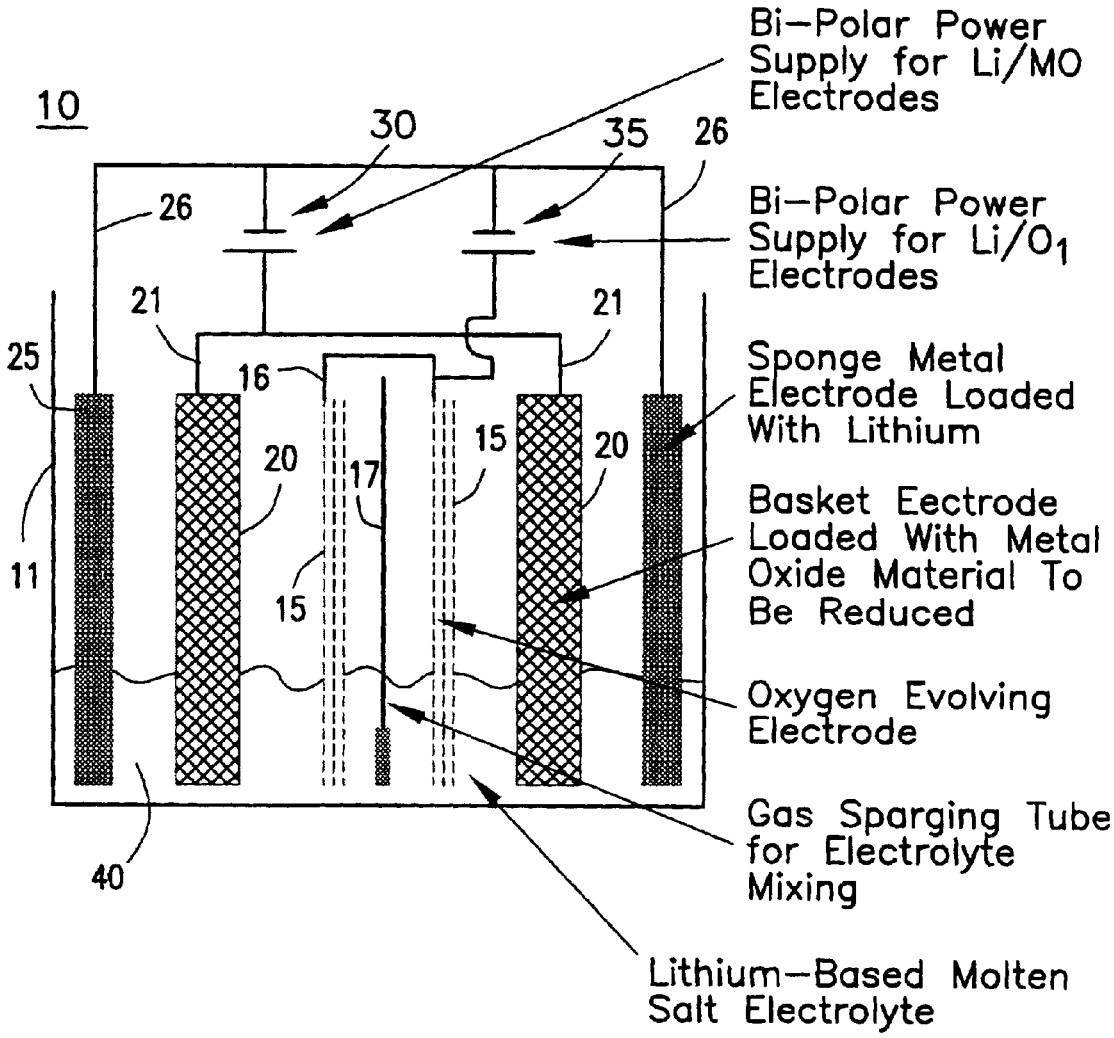
FIG. 1 is a schematic illustration of an electrochemical cell having three electrodes wherein the third electrode acts as a common negative for an independent anode and an independent cathode circuit.

Referring to FIG. 1, there is a schematic of a three electrode cell 10 incorporating the invention. More specifically, the three electrode cell 10 includes a container 11 of any standard material impervious chemically to the materials which it contains. The cell 10 includes an anode 15, having a lead 16 extending therefrom, a cathode 20 having a lead 21 extending therefrom and a third electrode 25 having a lead 26 extending therefrom. A gas sparging device 17 is located near the anode 15 to conduct gas (oxygen) out of the cell 10 during cell operation. The third electrode 25 is maintained at a negative potential relative to each of the anode 15 and the cathode 20 and is provided with a power supply 30 intermediate the third electrode 25 and the cathode 20, and another power supply 35 independent of the power supply 30 intermediate the third electrode 25 and the anode 15.

The physical location of the three electrodes may be as illustrated or in any combination thereof such as with the third electrode 25 intermediate the cathode 20 and the anode 15 or with the anode intermediate the third electrode and the cathode or as illustrated with the cathode intermediate the third electrode and the anode. An electrolyte 40, molten in operation as well understood in the art, is provided and may be any halide salt of the alkali metals or the alkaline earth metals, or eutectics or mixtures thereof, and in the example hereinafter provided the molten salt and electrolyte is a lithium chloride based electrolyte. The third electrode may be any material which is sufficiently fast, non-polarizable, that its potential does not vary enough to cause the slower of the other electrodes to penetrate an undesirable voltage regime, no matter what the current to the faster electrode may be such as lithium. By undesirable voltage regime we mean, for instance, chlorine evolution if the anode potential is too great or lithium deposition if the cathode potential is too negative. The cathode is usually, but not necessarily, a stainless steel basket in which the oxides are placed. Various mechanisms are known in the art to increase contact between the oxides and the cathode basket. The anode may be any suitable material which is not attacked by the products produced by the anode during the electrochemical reaction or by the molten halide salt electrolyte or material dissolved in the salt. In the present example, the anode is gold.

In general, the three electrode cells of the present invention may be used to reduce a wide variety of materials, such as rare earth oxides as well as actinide oxides. More particularly, the invention is useful in the reduction of uranium and the transuranics, a subset of the actinide oxides. Difficult to reduce oxides such as the oxides of Eu, Gd, Nd, Pr, Yb, La and Ce may be reduced. Moreover, it is believed that the oxides of Dy, Sc and Er may also be reduced.

In principle, use of a third electrode in a cell for electrolytic reduction in lithium-containing salt provides two major advantages:

1. Because the anode and the cathode are powered by separate power supplies having the third electrode as their common negative electrode, the potential of the anode and the cathode can be fixed simultaneously and independently at the values that give a maximum rate for each electrode.

In a conventional (two-electrode, single power supply) cell operated with voltage control, the overpotentials take whatever value is determined by applied voltage, cell materials and geometry. To increase rate, one can only increase the applied voltage until the slower of the two electrodes is forced into an unacceptable regime; chlorine evolution or lithium deposition in this case. At that applied voltage, the faster (less polarized) of the electrodes is not operating at its optimum potential (maximum rate). Similarly, if the conventional cell is operated at constant current, that current is limited by the slower electrode.

With a third electrode as common negative for independent anode and cathode circuits, the electrode potentials (or rates) of the anode and cathode can be optimized independently. This implies that the third electrode will provide some or all of the current necessary to support the faster electrode.

In principle, these optimum voltages need not be changed; control may thus be simplified considerably. The anode and cathode voltages are constant only with respect to the third electrode—the third electrode must be non-polarizable (fast) enough that its potential does not vary enough to cause the slower of the other electrodes to penetrate an undesirable voltage regime, no matter what the current to the faster electrode may be.

2. For oxide reduction, the third electrode allows the cathode to operate in a cell condition with little or no oxide in the electrolyte.

If a cell is to achieve reduction of transuranium actinides, it must have very little oxide in the electrolyte at the end of a run. This requires that it be started with as little oxide as possible in the electrolyte. In this condition, the anode of a conventional cell cannot carry significant current except by (undesirable) chlorine evolution. The cathode cannot operate if there is no anode to complete the circuit, hence the cell cannot start operation. In a three-electrode cell, the lithium electrode will temporarily act as an anode until the oxide concentration builds, allowing startup.

At the end of a run, the lithium electrode takes the place of the cathode, which has no more reducible uranium oxide, and so cannot carry current except by (undesirable) lithium deposition. This allows the anode to continue to operate and reduce the oxide concentration so that the transuranium (TRU) oxides in the cathode are also reduced.

Operation at low oxide levels is essential, because a low value of oxide concentration is required for the reduction of transuranium actinides, especially at practical rates. Furthermore, in the case of processing oxide nuclear fuel, some salt will carry over from the reduction vessel to the (downstream) electrorefiner, and oxide is undesirable in the electrorefiner.

The unique three-electrode cell of the present invention addresses the issues identified during the two-electrode cell studies. Two of the electrodes are similar in materials and construction to the electrodes in a standard two-electrode cell. Also, as described above, a lithium based molten salt electrolyte is used in the cell (e.g. LiCl). In this cell, however, no lithium oxide is added to the melt. The third electrode is a molten metallic lithium electrode. For the cell to operate properly, the molten lithium must be electrochemically and chemically accessible, but physically contained. This can be done with a sponge structure made from a metal that is wetted by lithium, but does not alloy with it. The cell, in principle, can be made to work in either a planar or cylindrical geometry by adjusting the individual electrode designs.

Initially, metal oxide is loaded into the cathode and an adequate amount of lithium is placed in the sponge metal electrode. An "adequate amount" can be defined as sufficient lithium to function as an anode to support the cathodic reduction process until oxide builds up in the electrolyte and the oxygen evolution anode takes over this function. Because containment of the lithium is critical and it is accomplished by surface tension, excess volume should be designed into the sponge metal electrode, so that it never becomes saturated with lithium. Although the exact amount of lithium required can depend on many factors, a highly conservative upper bound can be set by the capacity needed to completely reduce the metal oxide.

Although there are a number of ways to control the potential of the electrodes in the cell (e.g. using a combination of a power supply and electronic load), one effective method is through the use of two bi-polar power supplies, both of which have their negative side connected to the lithium electrode. One of the power supplies is used to polarize the metal oxide cathode to just above the potential for significant lithium reduction. Since the potential for reduction of most metal oxides is higher than the potential for lithium ion reduction, polarizing the metal oxide electrode in this manner will maximize the rate of metal oxide reduction and still prevent reduction of lithium on the metal oxide electrode. The second power supply is used to polarize the oxygen electrode to just below the potential for excessive chlorine production. This potential, of course, will be set at a relatively low value if the oxygen electrode potential stability window does not extend well into the chlorine evolution region. In any case, for proper operation, the anode must be polarized well into the oxygen evolution potential range. Because the lithium electrode is exceedingly reversible, it provides a constant voltage, even under current draw. Thus, the power supplies would be set once to provide the proper voltages and would need no further adjustment or control.

Unlike the two-electrode cell, cell operation begins with no lithium oxide in the electrolyte and no oxygen production at the anode. Metal oxide is being reduced at the maximum rate possible through a combination of the cathodic electrochemical reaction, given by reaction [2], and a chemical reaction, shown below by reaction [4].

$$MO_x+2xLi \rightarrow M+xLiO_2 \quad [4]$$

This chemical reaction can occur because metallic lithium is slightly soluble in the electrolyte melt, but it is not expected to be as significant as the electrochemical reduction of the metal oxide, except perhaps initially. The counter electrode for the cathodic process is the lithium electrode where lithium is being oxidized, according to the forward direction of reaction [5].

$$Li \leftrightarrows Li^+ + e^- \quad [5]$$

The lithium electrode also serves as the source of dissolved lithium for any chemical reaction at the cathode.

Both the electrochemical and chemical reactions have the net effect of consuming lithium from the sponge metal lithium electrode and producing lithium oxide in the electrolyte. Over time the lithium oxide concentration in the electrolyte builds up and oxygen anions begin to be oxidized at the oxygen electrode at a correspondingly more rapid rate. This reaction is shown in reaction [3] it eventually completely replaces oxidation of lithium from the lithium electrode. Initially the counter electrode (cathode) for the oxygen-evolving anode reaction is the metal oxide cathode. Eventually, the lithium electrode serves this function. As the metal oxide in the cathode is consumed reaction [5] begins to occur in the backwards direction and lithium is placed back into the sponge metal electrode. To summarize: early in the process the net reaction on the lithium sponge metal electrode is anodic because the oxygen-evolving anode cannot support as much current as the metal oxide cathode can produce. At some point the lithium electrode changes to a net cathodic reaction as the metal oxide cathode becomes unable to support the current at the oxygen-evolving anode. Metallic lithium is formed by the cathodic reaction at the lithium electrode and returned to the metal sponge. Ideally, the net effect at the end of the process is to have all of the metal oxide reduced, no lithium oxide in the electrolyte, and all the lithium back in the sponge metal electrode. The cathode containing the reduced oxide can be removed and replaced with new oxide to start the process over again.

Because the oxygen-evolving anode consumes lithium oxide, the final level of lithium oxide in the electrolyte is only limited by time. To achieve a high rate of lithium oxide consumption, the oxygen anion must be transported rapidly through the electrolyte to the anode. Rapid mixing of the electrolyte is thus beneficial. Although there are numerous methods for mixing the electrolyte, including natural convection, FIG. 1 is shown with a gas sparging tube. Gas sparging near the oxygen-evolving electrode not only helps mix the electrolyte, but it also serves to more efficiently remove the oxygen from the cell. Other options for mixing include the use of stirrers or moving one or more of the electrodes. Whatever the method of mixing, it must be done in a way that does not entrain oxygen bubbles in the electrolyte. Entraining oxygen bubbles in the electrolyte would significantly increase the amount of oxygen reaching the lithium and metal oxide electrodes and would thereby cause a reduction in the overall current efficiency of the cell.

The design and placement of the electrodes has a significant impact on the transport of lithium oxide through the electrolyte to the oxygen-evolving anode. As an example, interchanging the positions shown in FIG. 1 for the metal oxide electrode and the oxygen electrode has the distinct advantage of keeping the dissolved lithium oxide in the electrolyte better contained. It does, however, limit the amount of dissolved lithium metal that could reach the metal oxide electrode and increases the amount of dissolved lithium that can reach the cathode, thereby placing additional constraints on the choice of cathode materials. For any specific application, the electrode placement may depend on the relative importance of the chemical reduction of the metal oxide (reaction [4]) and the time required to bring down the dissolved lithium oxide concentration to an acceptable level.

This three-electrode metal oxide reduction cell offers a number of advantages over the two-electrode cell. Some of these advantages are listed below:

1. No lithium oxide needs to be added to the electrolyte for proper operation. The only oxygen containing compounds added to the cell are the metal oxides themselves. Most or even nearly all of the lithium oxide formed during initial stages operation is consumed in the final stages.

2. Because the lithium electrode can support very large currents, the reduction of metal oxide always proceeds at the maximum rate possible, which is theoretically limited only by the diffusion of lithium oxide away from the reaction front.

3. Since the metal oxide electrode potential is always above lithium production potential, there is no concern that excess lithium would be formed there and would cover the oxide reaction surface or create loose floating lithium droplets.

4. The need for a second power supply is offset by the simple and highly effective control scheme of constant applied voltage.

5. The complete process can all be done in one vessel with near zero oxygen content at the end of the process possible. A two-electrode reduction might require a change of electrode near the end of the process, or perhaps even a second electrolysis vessel.

6. Although the total amount of oxygen production is equivalent in either cell design, the current to the oxygen electrode will be more uniformly distributed over the reduction process in the three-electrode design.

7. The lithium electrode overvoltages should be relatively small, even at high rates. Thus the electrode would act as a pseudo-reference electrode in the cell and lessen or obviate the need for reference electrodes in the cell.

The following example illustrates the use of the invention in the context of reducing uranium dioxide substantially completely. The uranium dioxide was representative of uranium and transuranics, encountered in the nuclear power generating industry.

The first practical operation of the three-electrode cell was carried out in LiCl electrolyte at 650° C. It was suspended from heat shields in a 10" diameter well in a helium-atmosphere drybox. Because the purification system employed a carbon bed at liquid nitrogen temperature, nitrogen levels were so low that significant $Li_3N$ formation did not occur, even when Li was exposed for several hours at 650° C.

Lithium chloride from Anderson Physics Laboratories (592 g) was contained in a 10 cm diameter by 13 cm high stainless steel cylinder that was suspended from insulators. The cathode was rested on the bottom of the container to hold the container at a known potential. The other electrodes were suspended in the salt. Separation of electrodes from each other and from the container (cathode-container contact excepted) was nominally 1.5–4 cm., although lateral positioning was somewhat uncertain. Electrode leads were all approximately 45 cm long. The cathode and anode leads were welded to their respective electrodes. Each electrode was provided with a "sense" electrode welded to the current lead within approximately 3 cm of the salt surface. This permitted nearly all IR losses to be kept out of the control circuits, and fairly accurate electrode voltages to be recorded. All leads were insulated with alumina tubes that ended 12 cm above the salt to avoid salt wicking.

The cathode was a stainless steel mesh basket of about 23 $cm^2$ area containing 20.93 g of $UO_2$. The basket was lined with 325-mesh SS screen. The $UO_2$ particle size distribution ranged from 0.6 to 1.2 mm. The cathode lead was a ⅛" diameter stainless steel rod.

The third electrode comprised 1.7 g of lithium in a stainless steel sponge (6.2 milliliters, approximately 95% porosity). The sponge was penetrated by and loosely wired to a ⅛" SS rod that served as current lead.

The anode was a gold flag of 25 $cm^2$ area (both surfaces) on a gold wire of 2 mm diameter. The gold wire was welded to a bare Cu wire (#12 A.W.G.) about 10 cm above the flag. Inadvertently, only about half of the flag was submerged in the molten salt.

The power supplies were Kepco BOP-20 units of 20 Ampere Capacity; they could be controlled within 1 or 2 millivolts. They provided a current signal accurate to about 7 mA, but stable to 1 mA or better. Output control was good to approximately 1–2 mV. Provision was made for interrupt of the cathode circuit only.

Data were recorded and control voltages were set with National Instruments SCXI 1100 and 1300-series A/D and D/A multi-channel devices, controlled via LabView 5.0 running under Windows 2000. Voltages measurement accuracy was apparently 10 mV most of the time, but operation was somewhat erratic. Control of the cathode potential, in particular, was poor with offsets less than 50 mV seen at times and manually compensated. Extensive calibration was deferred to future tests.

The minimum usable cathode potential was thought to be somewhere "just" above the potential of the lithium electrode, in order to avoid or reverse lithium deposition at the cathode, and yet achieve high rate. Good control and measurement of this potential are needed.

Containment of lithium in the stainless sponge was a concern—lithium wetting of stainless is slow, requiring electrode loading at 650° C. for several hours. Metallic lithium phase elsewhere in the cell is a serious issue. In this design, the only lithium containment is provided by surface forces within the sponge.

Lithium is somewhat soluble in LiCl at 650° C. Dissolved lithium will diffuse to the anode to some extent, and be oxidized, resulting in a "background" current that could conceivably be quite large.

Lithium will also alloy with gold if no protective measures are taken. The gold electrode was kept at a minimum 2.8V vs. lithium to attempt to oxidize any Li that reached it.

Chlorine will be evolved at the anode at 1 atm. pressure at about 3.3 V vs. Li. Chlorine activity decreases at about one decade per 100 mV. Gold is oxidized at a potential about 0.3 V above chlorine evolution, but if the solubility coefficient of gold chloride is small, or there is a sink for gold (any part of the cell at low potential) gold oxidation can occur at lower potentials, namely 61 mV per decade of gold chloride activity reduction below 1.0. Except for a short initial run to verify the onset of some oxidative process, anode voltage was set to 2.9 V to avoid oxidation of gold or chloride ion.

The cell was brought to 650° C. with all electrodes retracted above the salt level. The initial operations were intended to establish limits for operation.

The anode power supply was set to 2.8 V, and turned on. First the anode, then the lithium electrode were inserted into the salt. About 85 seconds after lithium electrode insertion, the anode background current increased abruptly from about 7 ma to about 35 mA, indicating very rapid lithium transport in the cell.

After about 10 minutes, the anode potential was increased in 50 mV increments to 3.25V and back down to 2.9 V; an exponential increase in current began to be observable at 3.15 V. Maximum current drawn was about 225 mA at 3.25 V. There was no significant increase in the noise in the current signal, as would be expected with gas evolution. The anode potential was reduced to 2.9 V.

After 3 hours of stable operation in this configuration with about 30 mA background current, the cathode potential was set to 1 V, and the cathode (uranium electrode) was inserted. Cathode background current at this potential was near 50 mA positive (anodic).

The cathode potential was incremented down and back up; it "spiked" in a cathodic direction at each downward change. At about +0.3 V the current remained negative (cathodic) and at zero potential the current was about −250 mA. The time when current remained negative was taken as the onset of the reduction process. The anode current increased substantially about 20 minutes later—this is a reflection of the oxide diffusion time characteristics of the cell.

During the first 1.6 hours of the reduction process, the voltage was adjusted frequently; the average voltage and current during this period were ±5 mV and −450 mA. The potential was incremented briefly to −0.25 V, resulting in a current of approximately −650 mA, then back up to +0.025 V, resulting in an observed cathode potential that drifted within about 20 mV of zero. Briefly increasing the cathode potential setpoint to 100 mV resulted in an observed voltage of approximately +50 mV and a current near zero.

The setpoint was then made +25 mV and left at this value for 16.2 hours. It was changed to +100 mV for 0.6 hours, then set to 60 mV at a total reduction time of 18.4 hours. At this time the reduction was essentially complete, but operation was continued to observe anode behavior.

FIGS. 2–5 present the course of the example. Note in particular the relatively large background (lithium oxidation) currents, especially at the anode.

Figure 2:
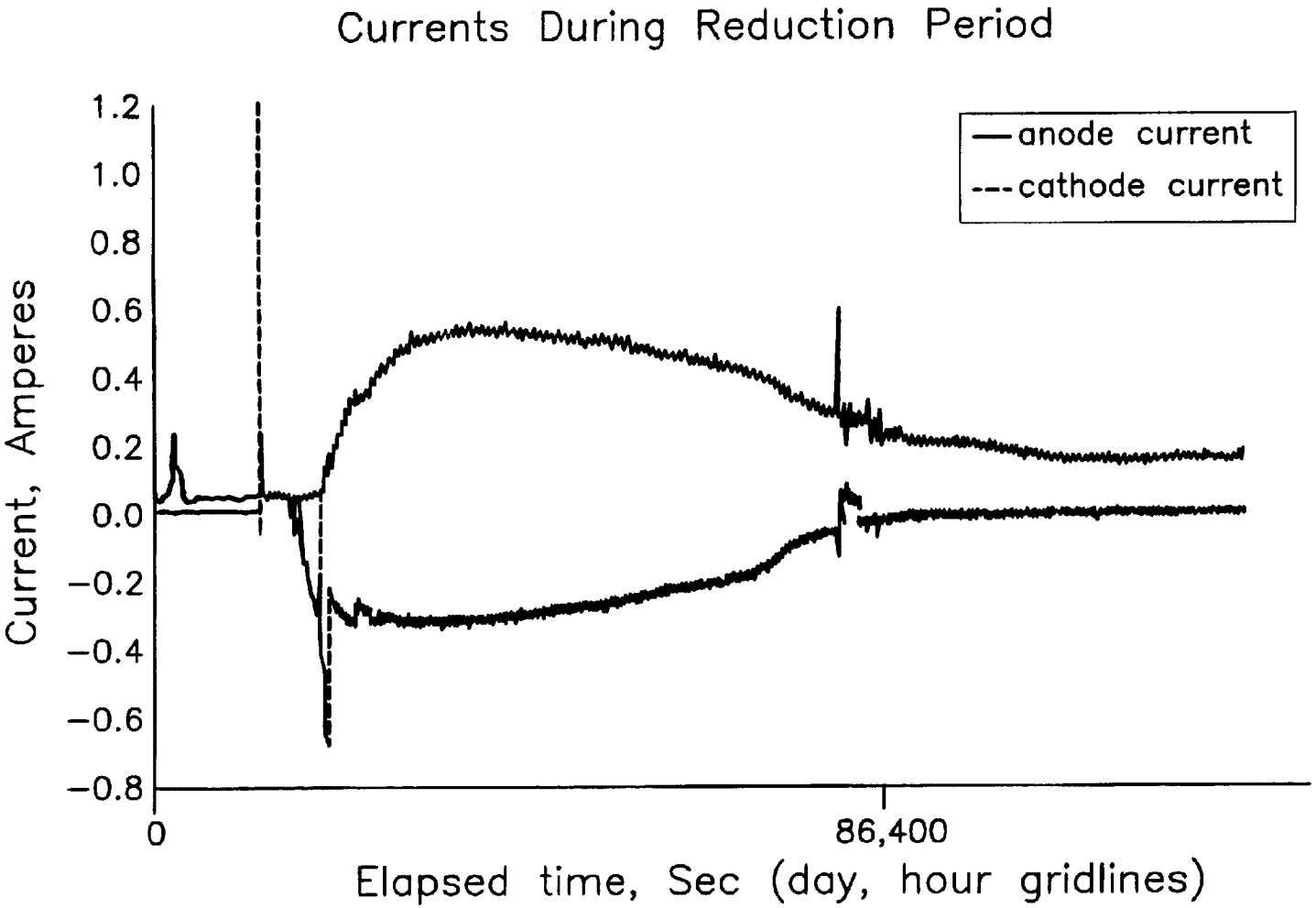
FIG. 2 is a graphical representation showing the variation in current as a function of time in the operation of an electrochemical cell incorporating the subject invention.
Figure 3:
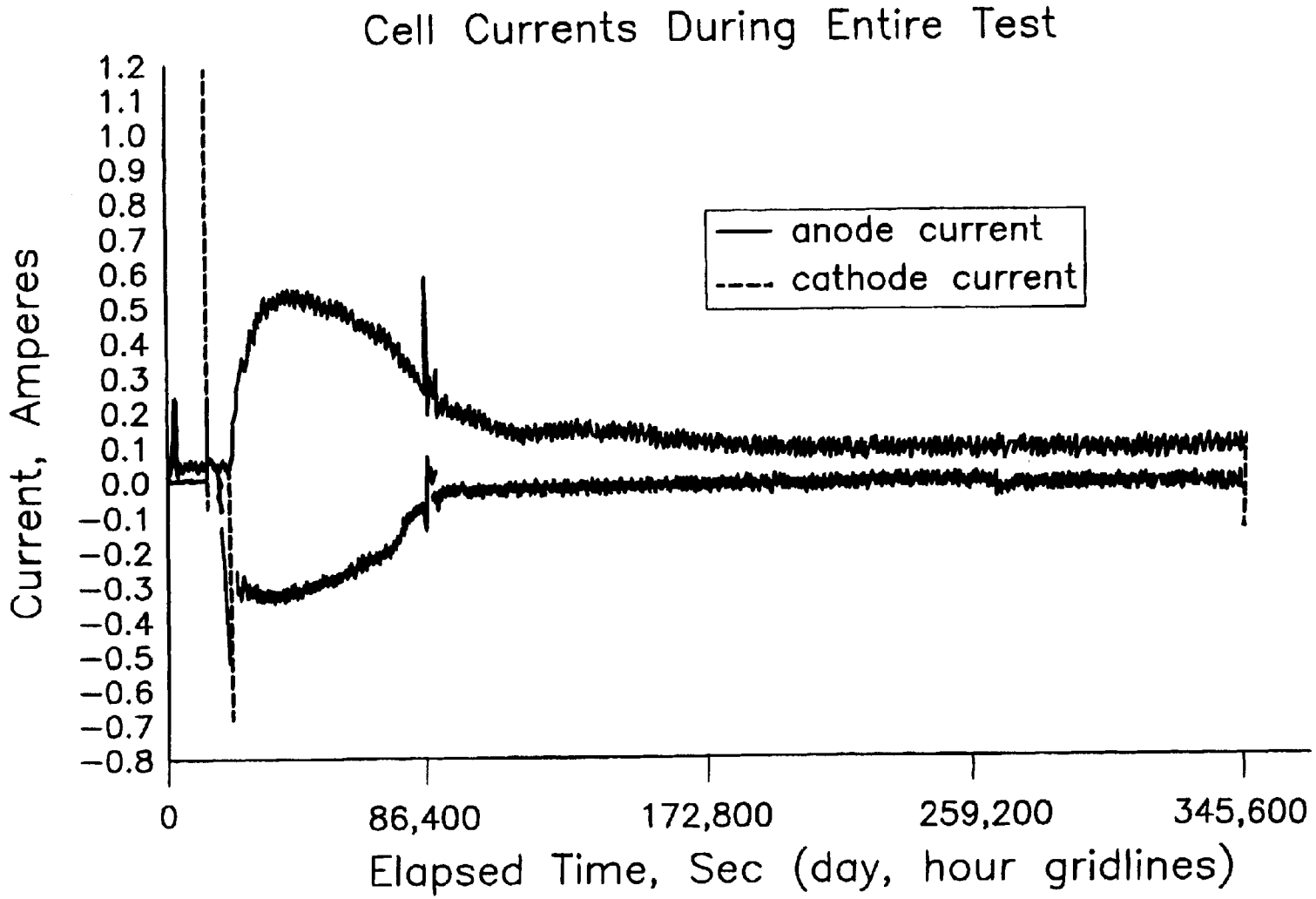
FIG. 3 is a graph like FIG. 2 except that the lapsed time on the X axis of the graph is considerably longer.

Referring now to FIGS. 2 and 3, there is illustrated in the graphical representation the relationship of the anode current, the top curve and the cathode current, the bottom curve during the course of the first day of the run and in FIG. 3, the entire run. As can be seen at the time zero, from the Y axis to the first dotted line is the cell startup. To the right of the dotted vertical line is the beginning of the run. It will note that the cathode potential becomes negative indicating that the reduction of the oxides has begun prior to the time that the anode current rises because in the beginning of the cell operation, there is no oxide in the electrolyte to begin oxidation. After the cathode begins operation, it produces oxide ion, then the anode will begin to carry current. As the example proceeded, the cathode current started at about 0.3 amps and continued to decline until reduction was complete and moved toward zero, as seen in FIGS. 2 and 3. The anode current also began to diminish with the cathode, but in a delayed fashion and also continued toward zero. The anode and the cathode currents did not precisely diminish to zero because there was always some lithium ion and oxide ion in the cell as background materials.

Figure 4:
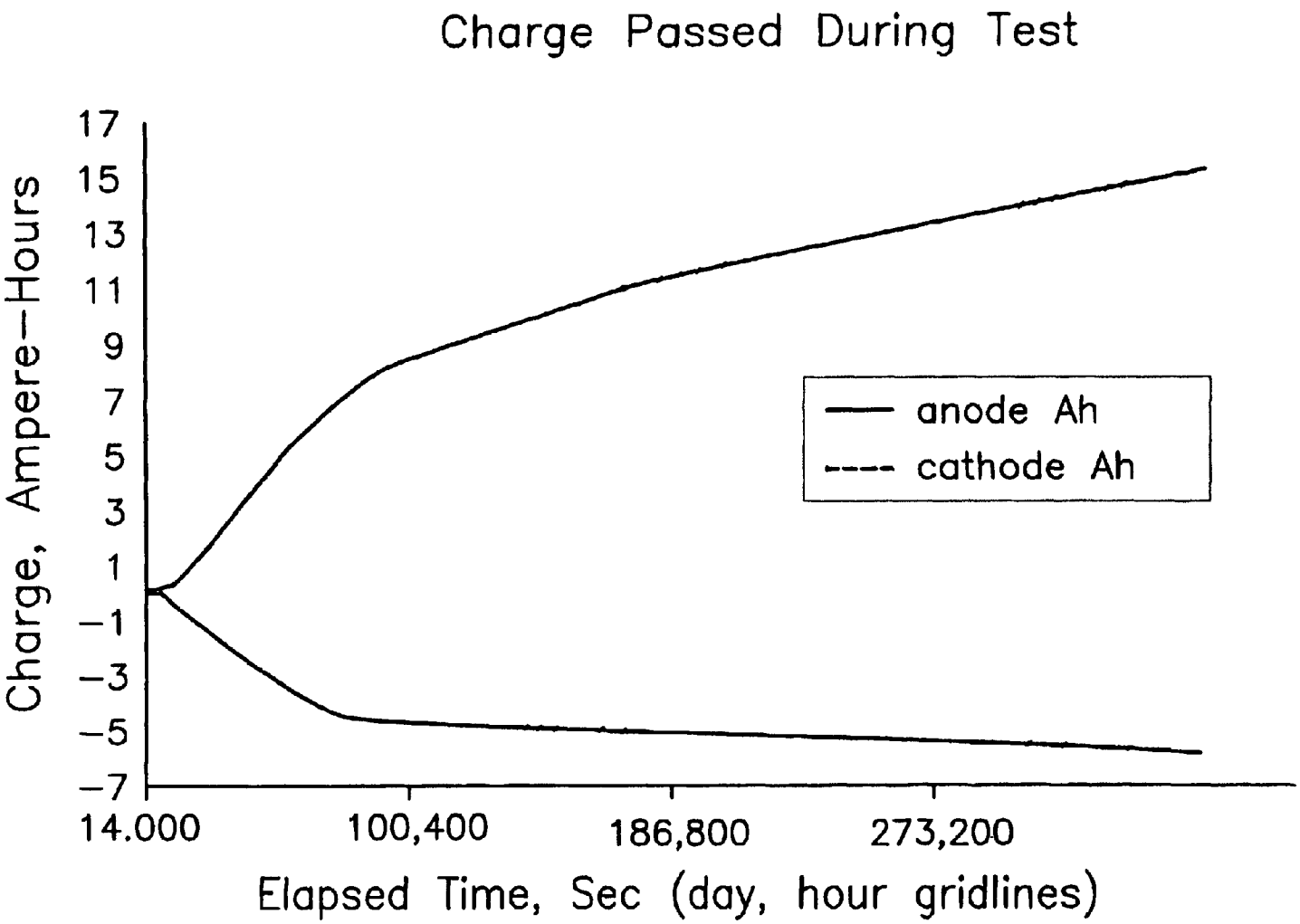
FIG. 4 is a graphical representation of the relationship between the charge passed during the example and the elapsed time individually for the cathode and the anode.

Referring to FIG. 4, there is illustrated voltage for both the cathode and the anode. The straight lines of the voltage curves to the right of about two days is steady state operation of the cell. It should be noted that FIG. 4 is simply the integral of FIGS. 2 and 3. As noted, the reduction of the cathode current occurs after about 4-½ amp hours of charge has been passed (approximately 20.3 hours after the onset of reduction). Although the amount of oxide loaded into the cathode theoretically should have consumed about 8 amp hours of charge, probably due to parallel reactions occurring in the cell, the reduction actually consumed in about 4 to 4-½ amp hours as shown in FIG. 4.

Figure 5:
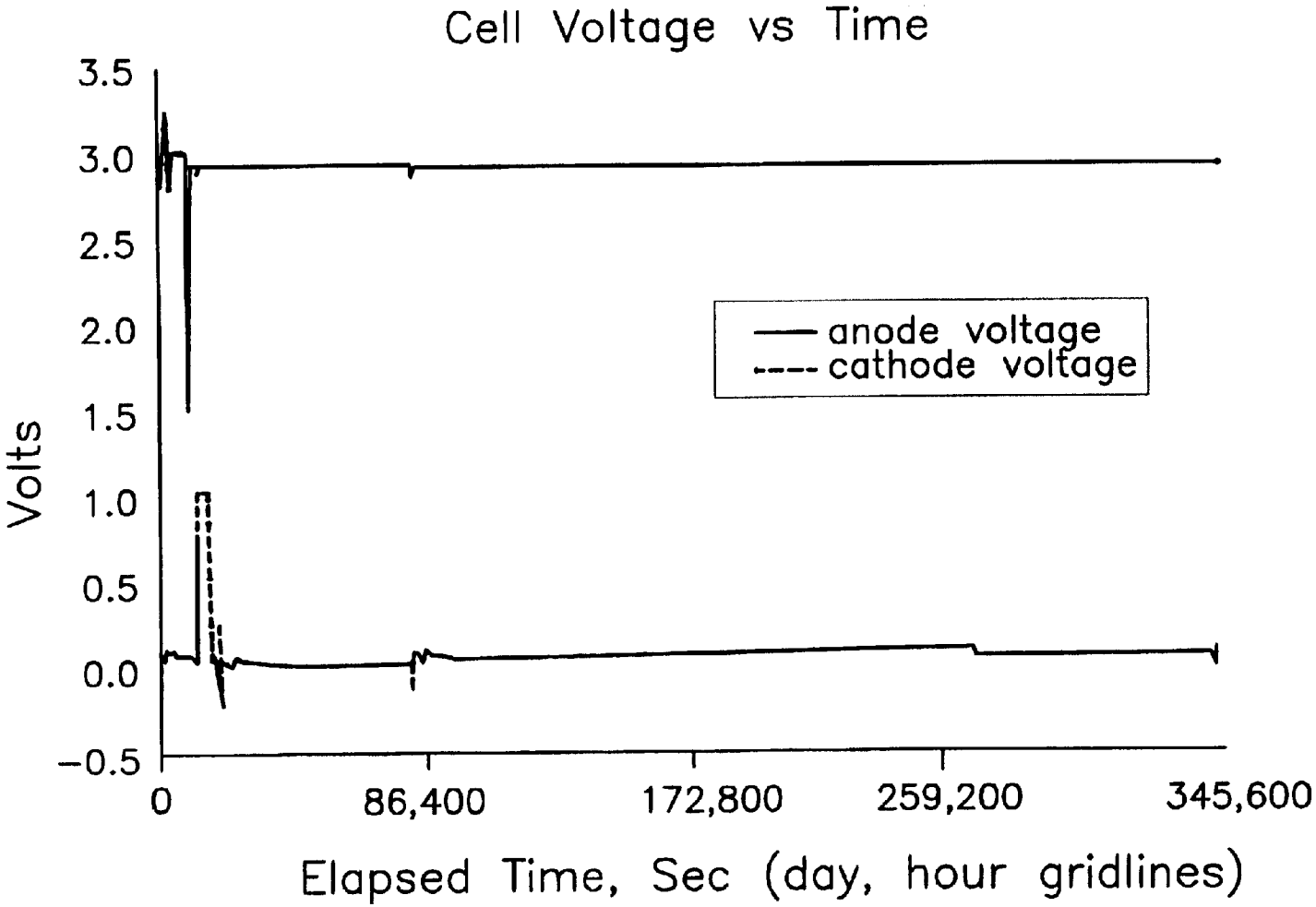
FIG. 5 is a graphical representation of the relationship between the cell voltage and time for each of the cathode and anode.

Finally, FIG. 5 shows the relationship between cell voltage and time with the anode voltage being the top positive line and the cathode voltage being the bottom line. The curves to the left of the spikes at the beginning of the run result from changing the voltage to the cell in the beginning of the example and do not form a part of the example. The power supplies used provided a constant voltage as indicated for the entire run to the right of the dotted line in the cathode voltage curve.

On disassembly, the salt appeared light purple, consistent with dissolved lithium. The anode was bright and shiny, but the part of the flag that had been in the salt was thinned by about 50%. Thinning is attributed to lithium attack. About 6% of the salt was lost from the vessel due to creep or volatilization. There was little salt on the heat shields or other parts of the apparatus above the cell, but some frozen droplets of salt on the outer bottom of the vessel and films on the sides of the vessel were seen. Shiny silver crystals on the inside bottom of the vessel proved to be $AuLi_3$, and a smooth metallic deposit with a slight golden hue on the outside of the vessel analyzed as Li—Au alloy. The cathode contents were shiny and metallic, but dark-colored.

Chemical analysis of the cathode contents gave a salt content of 20% and a lithium metal content of 0.2%. The solids remaining after salt dissolution analyzed as 4 and 5 weight % gold, 0.07 with the % tungsten impurity from the $UO_2$, feed, and 0.2 and 0.3 weight % lithium. Extent of uranium oxide reduction was 98.8% plus or minus 0.9% for one sample and 98.5% plus or minus 1.7% for the other. Overall analytical uncertainty is estimated at plus or minus 3%.

The actual design of the cathode or the anode is well known in the art and the cell will operate whether the anode is a flag or plate, as shown or a prism or any other useful shape. The entire cell itself can either be rectangular or cylindrical as may the electrodes be concentric cylindrical electrodes separated by an insulator such as magnesium oxide.

This invention although described with respect to molten salt electrolytes is not so limited, but applies to other electrolytes in general including for example aqueous or organic electrolytes.

While particular embodiments of the present invention have been shown and described, it will be appreciated by those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

The embodiments of the invention in which an exclusive property or privilege is claimed are defined as follows:

1. A method of electrochemically reducing a metal oxide to the metal in an electrochemical cell in which each of the anode and cathode operate at their respective maximum reaction rates depending on cell operating conditions including applied voltage and cell materials and cell geometry, said method comprising providing a molten salt electrolyte having a cation selected from one or more of the alkali metals, the alkaline earth metals, the eutectics and mixtures thereof, providing an anode at which oxygen can be evolved, providing a cathode including a metal oxide to be reduced, providing a third electrode of an alkali metal or an alkaline earth metal or mixtures or alloys thereof, providing a power supply connecting the anode and the third electrode, and providing a power supply connecting the cathode and the third electrode, whereby establishing and independently controlling voltage potentials between the third electrode and each of the anode and the cathode permits reduction of the metal oxide to the metal without either the anode reaction rate or the cathode reaction rate being limited by the other, resulting in substantially complete reduction of the metal oxide.

2. The method of claim 1, wherein the anode during cell operation operates at maximum reaction rate at substantially constant voltage with respect to the third electrode.

3. The method of claim 1, wherein the cathode during cell operation operates at maximum reaction rate at substantially constant voltage with respect to the third electrode.

4. The method of claim 1, wherein each of the anode and cathode operate at their maximum reaction rate with each being at substantially constant voltage with respect to the third electrode.

5. The method of claim 4, wherein the metal oxide is an oxide of one or more of the actinides.

6. The method of claim 5, wherein the metal oxide is an oxide of one or more of uranium and the transuranics.

7. The method of claim 4, wherein the metal oxide is an oxide of one or more of the rare earth oxides selected from the group consisting of the oxides of Eu Gd, Nd, Pr, Yb, La and Ce.

8. The method of claim 7, wherein the metal oxide is one or more of the rare earth oxides selected from the group consisting of the oxides of Dy, Sc and Er.

9. The method of claim 1, wherein the third electrode operates as an anode at the start of cell operation and as a cathode at the end of cell operation.

10. A method of electrochemically reducing an actinide oxide to the actinide in an electrochemical cell in which each of the anode and cathode operate at their respective maximum reaction rates depending on cell operating conditions including applied voltage and cell materials and cell geometry, said method comprising providing a molten salt electrolyte having a cation selected from one or more of the alkali metals, the alkaline earth metals, the eutectics and mixtures thereof and a low concentration of oxide ion, providing an anode at which oxygen can be evolved, providing a cathode including actinide oxide to be reduced, providing a third electrode of an alkali metal or an alkaline earth metal or mixtures or alloys thereof, providing a power supply connecting the anode and the third electrode, and providing a power supply connecting the cathode and the third electrode, whereby establishing and independently controlling voltage potentials between the third electrode and each of the anode and the cathode permits reduction of the actinide oxide to the actinide without either the anode reaction rate or the cathode reaction rate being limited by the other, resulting in substantially complete reduction of the actinide oxide while maintaining a low concentration of oxide ion in the electrolyte.

11. The method of claim 10, wherein the cation is an alkali metal ion.

12. The method of claim 10, wherein the cation is Li.

13. The method of claim 10, wherein the molten salt is a halide.

14. The method of claim 10, wherein the molten salt is a chloride.

15. The method of claim 10, wherein during cell operation the anode produces anode products and the anode is substantially chemically unreactive with the anode products and the electrolyte at the conditions of cell operation.

16. The method of claim 15, wherein the anode is an electrically conductive ceramic substantially chemically unreactive with the anode products and the electrolyte at the conditions of cell operation.

17. The method of claim 16, wherein the anode is an oxide.

18. The method of claim 10, wherein the anode is gold or an alloy thereof.

19. The method of claim 10, wherein the cathode includes one or more of uranium and the transuranic oxides.

20. The method of claim 10, wherein the voltage of the anode is maintained substantially constant with respect to the third electrode during the reduction of the actinide.

21. The method of claim 10, wherein the voltage of the cathode is maintained substantially constant with respect to the third electrode during the reduction of the actinide.

22. The method of claim 10, wherein the voltage of each of the cathode and the anode is maintained substantially constant with respect to the third electrode during the reduction of the actinide.

23. The method of claim 22, wherein the third electrode acts as an anode at the start of cell operation and as a cathode at the end of cell operation.

24. The method of claim 22, wherein the third electrode is a metal of a cation in the electrolyte.

25. The method of claim 10, wherein the third electrode is intermediate the cathode and the anode.

26. The method of claim 10, wherein the anode is intermediate the third electrode and the cathode.

27. The method of claim 10, wherein the cathode is intermediate the third electrode and the anode.

28. The method of claim 10, wherein the actinide includes uranium and the oxide ion concentration at the end of the reduction is less than about one ppm.

29. The method of claim 28, wherein the actinide oxide includes one or more of the transuranic oxides.

30. A method of electrochemically reducing one or more of a rare earth oxide and/or an actinide oxide to the metal in an electrochemical cell in which each of the anode and cathode operate at their respective maximum reaction rates depending on cell operating conditions including applied voltage and cell materials and cell geometry, said method comprising providing a molten halide salt electrolyte having an alkali metal cation and a low oxide ion concentration, providing an anode at which oxygen can be evolved, providing a cathode including one or more of a rare earth oxide and an actinide oxide to be reduced, providing a third electrode of an alkali metal in the salt electrolyte, providing a power supply connecting the anode and the alkali metal third electrode, and providing a power supply connecting the cathode and the alkali metal third electrode, whereby establishing and independently controlling voltage potentials between the alkali metal third electrode and each of the anode and the cathode permits substantially complete reduction of the selected rare earth and/or actinide oxides to the corresponding rare earth and/or actinide without either the anode reaction rate or the cathode reaction rate being limited by the other.

31. The method of claim 30, wherein the molten halide salt electrolyte includes LiCl.

32. The method of claim 30, wherein the third electrode includes Li.

33. The method of claim 32, wherein the anode and the cathode are each operated at a constant voltage during the reduction of the actinide oxide and/or the rare earth oxide.

34. The method of claim 30, wherein the actinide oxide includes one or more of uranium and the transuranics and the oxide ion concentration at the end of the reduction is less than about one ppm.

35. The method of claim 34, wherein the rare earth oxide if present is one or more of Eu, Gd, Pr, Yb, Nd, La and Ce.

36. The method of claim 35, wherein the actinide oxide if present is one or more of the uranium and the transuranic oxides.

37. The method of claim 36, wherein each of the anode and cathode operate at their maximum reaction rate with each being maintained at substantially constant voltage with respect to the third electrode.

38. The method of claim 37, wherein the third electrode is Li and the electrolyte includes LiCl.

39. The method of claim 38, wherein the third electrode operates as an anode at the start of cell operation and as a cathode at the end of cell operation.

40. A method of electrochemically reducing a metal oxide to the metal in an electrochemical cell in which each of the anode and cathode operate at their respective maximum reaction rates depending on cell operating conditions including applied voltage and cell materials and cell geometry, said method comprising providing an electrolyte that will support the anodic and cathodic reactions, providing an anode at which oxygen can be evolved, providing a cathode including a metal oxide to be reduced, providing a third electrode that substitutes for either the metal oxide cathode or the oxygen evolving anode as required, providing a power supply connecting the anode and the third electrode, and providing a power supply connecting the cathode and the third electrode, whereby establishing and independently controlling voltage potentials between the third electrode and each of the anode and the cathode permits reduction of the metal oxide to the metal without either the anode reaction rate or the cathode reaction rate being limited by the other, resulting in substantially complete reduction of the metal oxide.

* * * * *